US008633829B2

(12) United States Patent
Cavanaugh

(10) Patent No.: US 8,633,829 B2
(45) Date of Patent: Jan. 21, 2014

(54) CAMERA SECURITY SYSTEM

(76) Inventor: Martin M. Cavanaugh, Surprise, AZ (US)

( * ) Notice: Subject to any disclaimer, the term of this patent is extended or adjusted under 35 U.S.C. 154(b) by 267 days.

(21) Appl. No.: 13/180,607

(22) Filed: Jul. 12, 2011

(65) Prior Publication Data

US 2013/0014549 A1 Jan. 17, 2013

(51) Int. Cl.
*G08B 5/00* (2006.01)

(52) U.S. Cl.
USPC ..... 340/815.4; 340/5.3; 340/5.51; 340/5.55; 340/5.73; 70/286; 235/130 R

(58) Field of Classification Search
USPC ..... 340/815.4, 5.3, 5.51, 5.55, 5.7, 5.73; 235/382, 128, 130 R; 70/63, 286
See application file for complete search history.

(56) References Cited

U.S. PATENT DOCUMENTS

| | | | | |
|---|---|---|---|---|
| 4,453,390 | A | 6/1984 | Moritz | |
| 4,455,552 | A | 6/1984 | Greiner | |
| 4,539,828 | A * | 9/1985 | Teleky | 70/369 |
| 5,451,934 | A | 9/1995 | Dawson | |
| 5,640,862 | A | 6/1997 | Remenicky | |
| 6,016,677 | A * | 1/2000 | Clark | 70/416 |
| 6,259,352 | B1 | 7/2001 | Yulkowski | |
| 6,363,763 | B1 | 4/2002 | Geringer | |
| 6,441,735 | B1 | 8/2002 | Marko | |
| 6,681,607 | B2 | 1/2004 | Geringer | |
| 7,221,273 | B1 | 5/2007 | Seyfarth | |
| 7,712,342 | B2 * | 5/2010 | Loughlin et al. | 70/366 |
| 7,880,585 | B1 * | 2/2011 | Aronson et al. | 340/5.73 |
| 8,436,731 | B2 * | 5/2013 | Davis et al. | 340/540 |
| 2007/0113607 | A1 * | 5/2007 | Huang | 70/432 |
| 2009/0179735 | A1 * | 7/2009 | Van Rysselberghe | 340/5.73 |
| 2011/0187496 | A1 * | 8/2011 | Denison et al. | 340/5.53 |

* cited by examiner

*Primary Examiner* — Toan N Pham
(74) *Attorney, Agent, or Firm* — Jason L. Gilbert

(57) ABSTRACT

A camera security system for securely detecting, recording and alerting the authorities of an attempted intrusion into a safe or other secure storage device. The camera security system generally includes a secure storage device having a door, a combination lock for selectively opening the door of the secure storage device and a sensor for detecting the positioning and movement of the combination lock. A recording device and communications device are provided and adapted to activate upon movement of the combination lock from a preset position. The recording device will preferably be concealed within a dial grip of the combination lock. Upon activation, the recording device will begin recording audio and/or video of the intrusion and the communications device will transmit an alarm signal to emergency responders.

17 Claims, 4 Drawing Sheets

CAMERA SECURITY SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a security system and more specifically it relates to a camera security system for securely detecting, recording and alerting the authorities of an attempted intrusion into a safe or other secure storage device.

2. Description of the Related Art

Any discussion of the related art throughout the specification should in no way be considered as an admission that such related art is widely known or forms part of common general knowledge in the field.

Secured storage devices such as safes and vaults have been in use for centuries. Throughout the years, various improvements were made to the locking mechanism which acts to prevent unauthorized access to the storage device. Safes will generally include a locking mechanism comprised of a dial with which a specific combination may be entered to provide access to the stored articles. However, such mechanisms may often be overcome by various techniques which allow an intruder to either correctly ascertain the combination or bypass the locking mechanism entirely.

While existing locking mechanisms such as combination-secured dials are often successful in securing articles within a safe or other device, there is always a risk of intrusion. In the event of such an intrusion, it is preferable to have some sort of alternative security device such as an alarm or recording system. However, these alarms and recording systems are generally comprised of motion sensors in the room in which the safe is located or cameras which are positioned at an unsecured location away from the safe which may be manipulated.

Because of the inherent problems with the related art, there is a need for a new and improved camera security system for securely detecting, recording and alerting the authorities of an intrusion into a safe or other secure storage device.

BRIEF SUMMARY OF THE INVENTION

A system for securely detecting, recording and alerting the authorities of an attempted intrusion into a safe or other secure storage device. The invention generally relates to a security system which includes a secure storage device having a door, a combination lock for selectively opening the door of the secure storage device and a sensor for detecting the positioning and movement of the combination lock. A recording device and communications device are provided and adapted to activate upon movement of the combination lock from a preset position. The recording device will preferably be concealed within a dial grip of the combination lock. Upon activation, the recording device will begin recording audio and/or video of the intrusion and the communications device will transmit an alarm signal to emergency responders.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
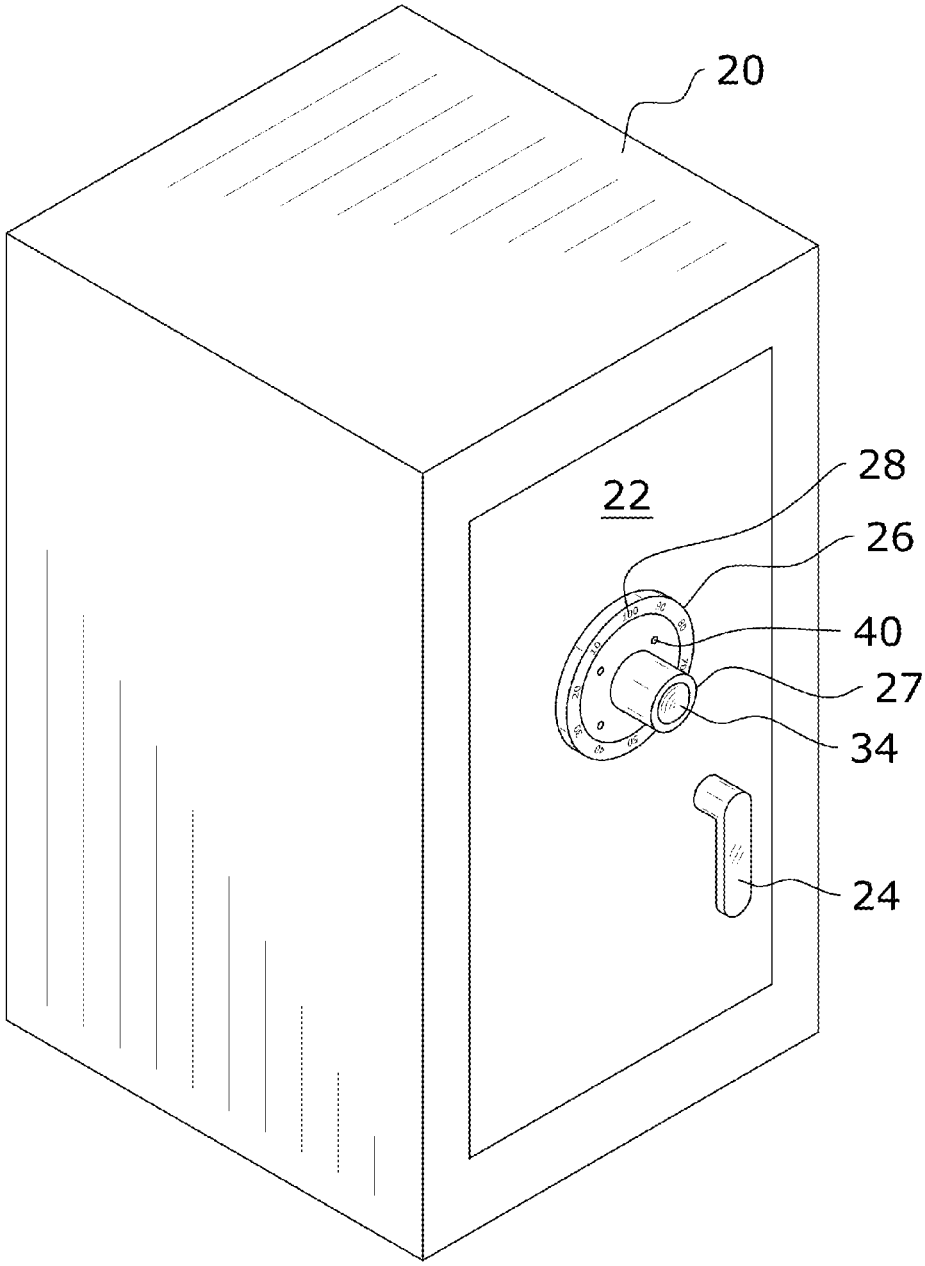
FIG. 1 is an upper perspective view of the present invention.

Turning now descriptively to the drawings, in which similar reference characters denote similar elements throughout the several views, FIGS. 1 through 4 illustrate a camera security system 10, which comprises a secure storage device 20 having a door 22, a combination lock 26 for selectively opening the door 22 of the secure storage device 20 and a sensor 32 for detecting the positioning and movement of the combination lock 26. A recording device 34 and communications device 36 are provided and adapted to activate upon movement of the combination lock 26 from a preset position. The recording device 34 will preferably be concealed within a dial grip 27 of the combination lock 26. Upon activation, the recording device 34 will begin recording audio and/or video of the intrusion and the communications device 36 will transmit an alarm signal to emergency responders.

B. Secure Storage Device

The present invention will generally be installed with a secure storage device 20. While the figures illustrate a rectangular safe having a specific configuration, it is appreciated by one of ordinary skill in the art that the present invention will function with any type of secure storage device 20 which includes an access door which is opened to access the stored articles. By way of example and without limitation, secure storage devices 20 for use with the present invention may include safes, vaults, deposit boxes or any other secured structure with an access door (i.e. a freezer or storage unit).

Turning to FIG. 1, a secure storage device 20 is shown which is comprised of a rectangular safe which includes a door 22. The door 22 will generally swing open to provide access to whatever articles are stored in the secure storage device 20. While the figures show a rectangular door 22 on a safe 20, it is appreciated that various types of doors 22 may be utilized with the present invention. The control unit 30 and other electrical components of the present invention will generally be positioned within the door 22.

The door 22 of the secure storage device 20 will generally include a latch member 24 and a combination lock 26. The latch member 24 will generally act to disengage a locking mechanism to allow the door 22 to be opened freely. The combination lock 26 will generally be comprised of a lock which will allow the locking mechanism of the door 22 to be disengaged upon turning of the latch member 24.

The combination lock 26 of the present invention may be comprised of various types of devices through which a combination or code may be entered to allow access to the secure storage device 20. Preferably, the combination lock 26 will be comprised of a combination lock mechanism known in the art which allows access after entry of the proper combination.

The combination lock 26 will also generally include a dial grip 27 which extends outwardly from the face of the combination lock 26 and numerical indicators 28 for allowing the entry of the combination as shown in FIG. 1. The recording device 34 of the present invention will generally be stored within the dial grip 27. However, it is appreciated that some embodiments of the present invention will function with combination locks 26 or other locks which do not include a grip 27 by, for example, positioning the recording device 34 within the door itself or the combination lock 26.

C. Control Unit

Figure 2:
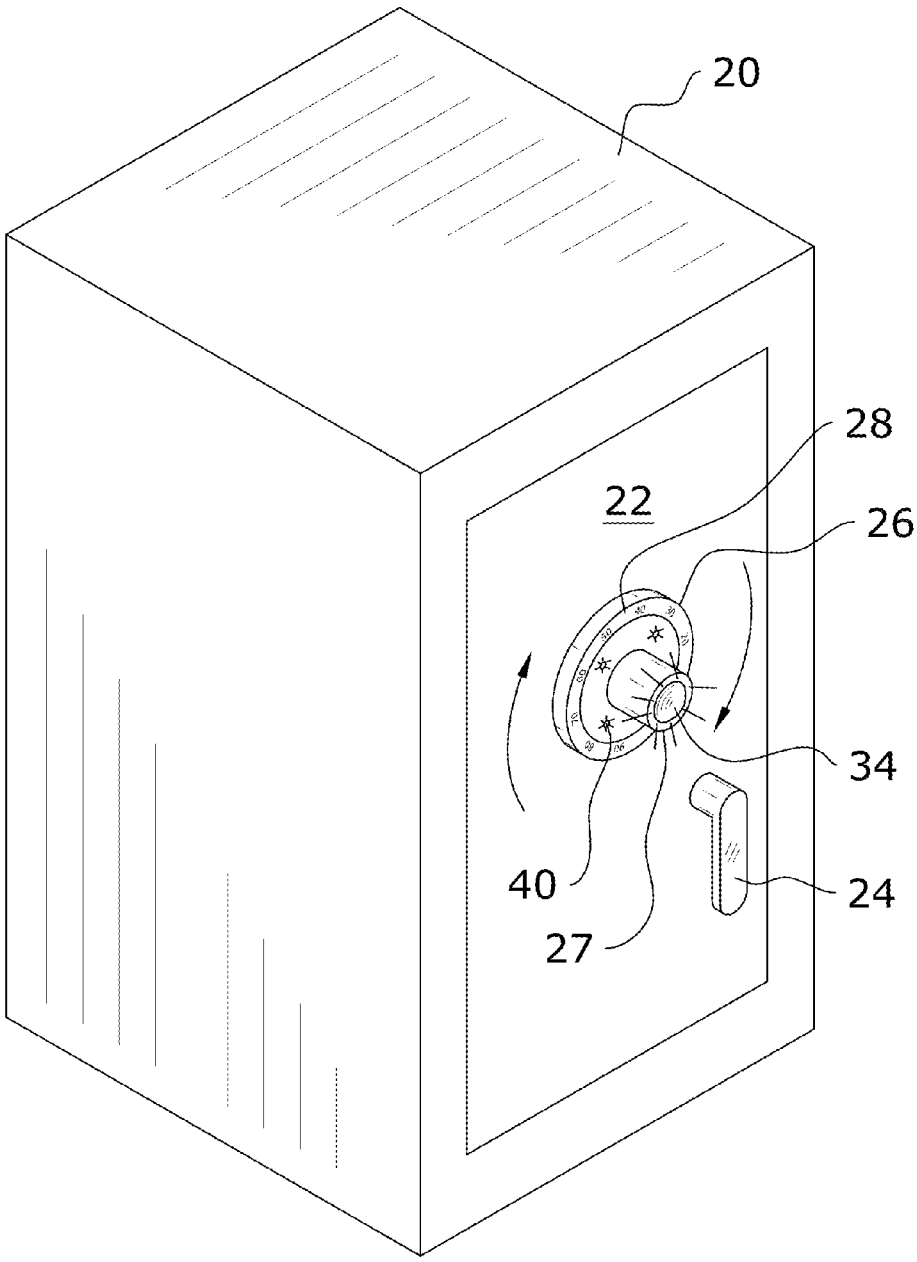
FIG. 2 is an upper perspective view of the present invention after detecting an intrusion.
Figure 3:
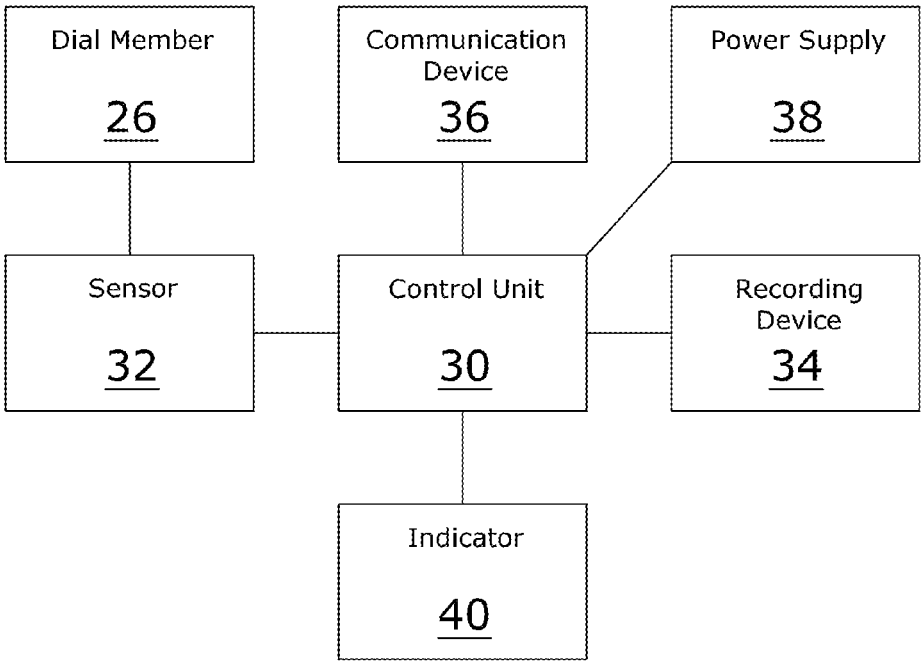
FIG. 3 is a block diagram of the present invention.

The present invention will generally include a control unit 30 for managing and implementing the various operations of the camera security system 10. As shown in FIG. 3, the control unit 30 of the present invention will generally be electronically connected to a sensor 32, a recording device 34, a communications device 36 and a power supply 38. In a preferred embodiment, the control unit 30, communications device 36 and power supply 38 will be positioned within the door 22 of the secure storage device 20. The recording device 34 will preferably be stored within the dial grip 27 of the combination lock 26 as illustrated in FIG. 2.

The control unit 30 will generally be comprised of a microprocessor, plurality of microprocessors or other electronic components which act to manage the overall operation of the present invention. The sensor 32 of the present invention will generally be configured to sense the positioning of the combination lock 26 as well as any movement of the combination lock 26 or lack thereof.

Preferably, the control unit 30 will determine the state of the present invention based on the sensor's 32 readings of the positioning and/or movement of the combination lock 26. The sensor 32 will generally instruct the control unit 30 to remain in an active state if the combination lock 26 is in a preset position. Preferably, the preset position will be comprised of a specific rotational position of the combination lock 26. Upon sensing that the combination lock 26 has been placed in the preset position for a preset amount of time, the sensor 32 will instruct the control unit to remain in an active state. It is appreciated that the preset position and preset amount of time may for different applications and to accommodate different users.

When the present invention is armed (i.e. the control unit 30 is in an active state), the sensor 32 will detect any movement of the combination lock 26. Upon sensing movement of the combination lock 26, the sensor 32 will instruct the control unit 30 to enter into an alarm state. During the alarm state, the control unit 30 will instruct the recording device 34 to activate and begin recording video and/or audio of the intrusion. The control unit 30 may also instruct the communications device 36 to contact the police and/or other authorities to respond to the intrusion.

The recording device 34 of the present invention is preferably comprised of a device capable of recording video and/or audio, such as an audio recorder or camcorder. Preferably, the recording device 34 will be positioned within the dial grip 27 of the combination lock 26 so as to be concealed and protected from tampering. It is also appreciated that, in some embodiments, the recording device 34 may be positioned within the door 22 of the secure storage device 20. The recording device 34 will generally be connected to the control unit 30 such that the recording device 34 will activate upon receiving instructions therefrom. After an intrusion, the video and/or audio data from the recording device 34 may be replayed to assist in investigation of the perpetrators.

The communications device 36 will preferably be comprised of a device which is configured to contact the police and/or other authorities in response to an intrusion. In a preferred embodiment, the communications device 36 will automatically place a telephone call to an emergency number and play a recorded message informing the authorities of the date/time of the intrusion as well as the location of the secure storage device 20. It is also appreciated that the communications device 36 may be configured through the control unit 30 to similarly contact the owner of the secure storage device 20 to inform him/her of the intrusion.

The use of an override code will prevent false alarms and unnecessary calls to the police. Preferably, the override code will be comprised of a specific combination to be entered on the combination lock 26 to allow the system to revert to the idle state from either the active state or alarm state. For example, when in the active state, the initial movement of the combination lock 26 will cause the device to enter the alarm state and cause the recording device 34 to activate. However, a short time period will be provided for entry of the override code prior to utilizing the communications device 36 to contact the police. Similarly, when in the alarm state, the override code may be entered at any time to stop recording and revert back to the idle state.

The control unit 30, sensor 32, a recording device 34, a communications device 36 and light indicators 40 of the present invention will preferably be powered by a power supply 38. The power supply 38 may be comprised of a battery, rechargeable battery or a direct connection to a wall socket or other source of electricity in the building in which the secure storage device 20 is kept. Preferably, the power supply 38 will be concealed within the door 22 of the secure storage device 20 so as to prevent tampering.

D. Light Indicator

The present invention may include one or more light indicators 40 positioned on or around the combination lock 26 as shown in FIG. 2. The light indicators 40 will generally be comprised of a source of light and will preferably be comprised of LED's. The light indicators 40 may be positioned at various locations, but will preferably be positioned on the face of the combination lock 26 as shown in the figures. It is also appreciated that any number of light indicators 40 may be utilized.

The light indicators 40 will preferably be adapted to emit different colors of light. Preferably, the light indicators 40 will display a first color when the present invention is in an idle state, a second color when the present invention is in an active state and a third color when the present invention is in an alarm state. The light indicators 40 will generally assist in preventing accidental alarm activation by the owner as well as warn the intruder of activation of an alarm. In a preferred embodiment, the first color will be comprised of a white light, the second color will be comprised of a green light and the third color will be comprised of a red light.

E. Operation of Preferred Embodiment

Figure 4:
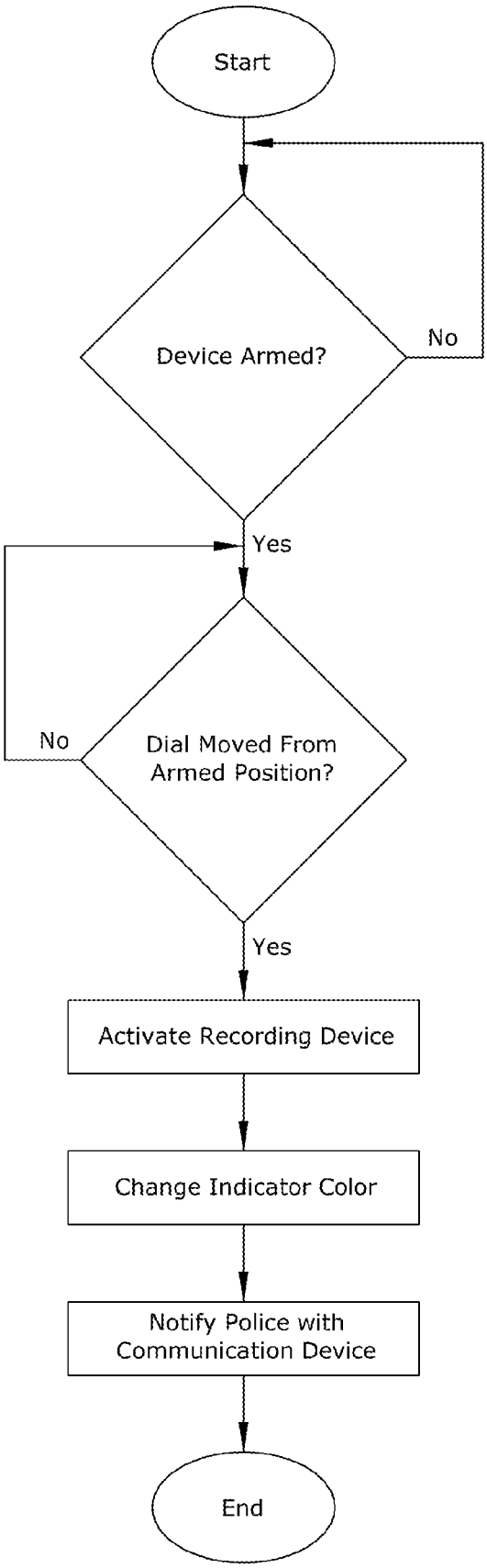
FIG. 4 is a flowchart illustrating the operation of the present invention.

FIG. 4 is a flowchart illustrating the general operation of the present invention. First, the camera security system 10 is armed by positioning the combination lock 26 in a preset position for a preset amount of time. Once armed, the light indicator 40 will generally turn from white to green to indicate to the operator of the present invention that the device is ready.

The sensor 32 will detect any movement of the combination lock 26 from its preset position. Upon such movement, the light indicator 40 will preferably turn from green to red to indicate that the camera security system 10 has entered an alarm state. The recording device 34 positioned within the dial grip 27 of the combination lock 26 will be activated and begin recording video and/or audio. Further, the communications device 36 will preferably contact the police and/or other authorities after allowing a short time for entry of an override code. In some embodiments, the communications device 36 may also contact the owner of the present invention to make him/her aware of the intrusion. Upon returning, the video and/or audio recorded by the recording device 34 may be played back to assist in investigation of the intrusion.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A camera security system, comprising:

a secure storage device including a combination lock;

a sensor for detecting movement of said combination lock;

a recording device, wherein said recording device is configured to activate upon movement of said combination lock from a preset position;

at least one indicator light, wherein said at least one indicator light is adapted to alternatively emit a first color, a second color or a third color, wherein said at least one indicator light emits said first color when said camera security system is in an idle state, said second color when said camera security system is in an active state and said third color when said camera security system is in an alarm state.

2. The camera security system of claim 1, wherein said secure storage device includes a door, wherein said recording device is positioned within said door.

3. The camera security system of claim 1, wherein said combination lock includes a dial grip, wherein said recording device is positioned within said dial grip.

4. The camera security system of claim 1, wherein said at least one indicator light is positioned on a face of said combination lock.

5. The camera security system of claim 1, further comprising a communications device, wherein said communications device is configured to transmit an alarm signal to emergency responders upon movement of said combination lock from a preset position.

6. The camera security system of claim 5, wherein said communications device is positioned within said secure storage device.

7. The camera security system of claim 6, further comprising a control unit for directing operation of said sensor, said communications device and said recording device.

8. A method of detecting an attempted intrusion into a secure storage device, comprising:

providing a secure storage device, wherein said secure storage device includes a combination lock;

providing a control unit and a recording device, wherein said control unit is positioned within said secure storage device, wherein said recording device is positioned within said combination lock;

providing a sensor for detecting positioning and movement of said combination lock;

arming the system by positioning said combination lock in a preset position for a preset amount of time; and recording with said recording device after said combination lock has been moved from said preset position.

9. The method of detecting an attempted intrusion into a secure storage device of claim 8, further comprising at least one indicator light.

10. The method of detecting an attempted intrusion into a secure storage device of claim 9, further comprising the steps of emitting a first color by said at least one indicator light when the system is in an idle state, emitting a second color by said at least one indicator light when the system is in an armed state and emitting a third color by said at least one indicator light when the system is in an alarm state.

11. The method of detecting an attempted intrusion into a secure storage device of claim 8, further comprising the step of providing a communications device, wherein said communications device is positioned within said secure storage device.

12. The method of detecting an attempted intrusion into a secure storage device of claim 11, further comprising the step of recording with said recording device after said combination lock has been moved from said preset position.

13. The method of detecting an attempted intrusion into a secure storage device of claim 12, wherein said recording device is comprised of a camcorder.

14. The method of detecting an attempted intrusion into a secure storage device of claim 13, further comprising the step of providing a power supply, wherein said power supply is positioned within said secure storage device.

15. The method of detecting an attempted intrusion into a secure storage device of claim 8, further comprising the step of disarming the system by entering a preset combination with said combination lock.

16. A camera security system, comprising:

a secure storage device including a combination lock and a door, wherein said combination lock includes a dial grip;

a sensor for detecting movement of said combination lock;

a recording device positioned within said dial grip, wherein said recording device is configured to activate upon movement of said combination lock from a preset position;

a communications device adapted to communicate an alarm to emergency responders, wherein said communications device is positioned within said door, wherein said communications device is configured to activate upon movement of said combination lock;

at least one indicator light positioned on a face of said combination lock, wherein said at least one indicator light is adapted to alternatively emit a first color, a second color or a third color, wherein said at least one indicator light emits said first color when said camera security system is in an idle state, said second color when said camera security system is in an active state and said third color when said camera security system is in an alarm state;

a control unit for direction operation of said sensor, said communications device and said recording device; and a power supply.

17. The camera security system of claim 16, wherein said at least one indicator light is comprised of a light emitting diode.

* * * * *